US005471274A

United States Patent [19]

Yamaguchi

[11] Patent Number: 5,471,274

[45] Date of Patent: Nov. 28, 1995

[54] AUTOMATIC FILM REWINDER

[75] Inventor: Takuji Yamaguchi, Wakayama, Japan

[73] Assignee: Noritsu Koki Co., Ltd., Wakayama, Japan

[21] Appl. No.: 254,914

[22] Filed: Jun. 6, 1994

[30] Foreign Application Priority Data

Jun. 7, 1993 [JP] Japan ..... 5-135988

[51] Int. Cl.[6] ..... G03D 13/00; G03D 7/00

[52] U.S. Cl. ..... 354/298; 354/354; 354/300

[58] Field of Search ..... 354/319–324, 354/339, 340, 345, 298

[56] References Cited

U.S. PATENT DOCUMENTS

| | | | |
|---|---|---|---|
| 5,227,827 | 7/1993 | Murakami | 354/333 |
| 5,231,439 | 7/1993 | Takahashi et al. | 354/321 X |
| 5,325,144 | 6/1994 | Yoshikawa et al. | 354/319 |
| 5,335,038 | 8/1994 | Blackman et al. | 354/319 |

FOREIGN PATENT DOCUMENTS

| | | |
|---|---|---|
| 2553611 | 6/1977 | Germany . |
| 5-11354 | 1/1993 | Japan . |

OTHER PUBLICATIONS

Patent Abstracts of Japan, vol. 17, No. 250 (P–1537) May 18, 1993.

*Primary Examiner*—D. Rutledge

*Attorney, Agent, or Firm*—Wenderoth, Lind & Ponack

[57] ABSTRACT

A device automatically rewinds a film of various sizes from its film cartridge to a magazine for use with a developing machine. The film cartridge of the film to be rewound is supported on a support member at an inlet side. The film is fed by a film feed device having feed rollers, a film feed motor and a film guide. It is taken up on a take-up magazine supported on a support at an outlet side. The rear end of the film is cut off from the film cartridge by a cutter.

7 Claims, 5 Drawing Sheets

AUTOMATIC FILM REWINDER

BACKGROUND OF THE INVENTION

This invention relates to an automatic film rewinder for rewinding films into a container for use with a developing machine before developing the film in the developing machine.

Since photographic films come in various sizes (110, 126, 135, etc.), they have to be rewound into a special magazine for use with a developing machine before developing them. Heretofore, such rewinding work has been carried out by putting both a film cartridge accommodating a film and the magazine in a black box, inserting both hands of an operator into the black box, and manually rewinding the film into the magazine.

Such rewinding work is extremely low in workability and efficiency, partly because such work has to be done manually, and partly because the operator cannot see the inside of the black box. Thus, it has been desired to automate this rewinding work.

SUMMARY OF THE INVENTION

An object of this invention is to provide an automatic film rewinder which can automatically pull a film out of its film cartridge and rewind it into another special container for use with a developing machine.

As a means to attain this object, there is provided according to this invention an automatic film rewinder comprising a first support means for supporting a first container accommodating a film, a cutter means for cutting the rear end of the film from the first container, a second support means for supporting a second container, a film feed device for feeding the film in the first container to the second container, and a take-up means for taking up the film into the second container supported in the second support means.

The take-up means is preferably provided with means for opening and closing a film inlet/outlet of the second container.

The film feed device may be provided with a curl remover for removing any curling tendency of the film while the film is being fed through the film feed device. Also, the film feed device may be provided with a magnetic head for reading any magnetic information recorded on the film and writing magnetic information into the film while the film is being fed through the film feed device.

The film pulled out of a film cartridge is fed to another container by the film feed device and taken up to the second container by the take-up device. When the rear end of the film comes out of the film cartridge, the film is cut therefrom by the cutting unit. The entire film is then wound into the second container.

The first container of the film, i.e. the film cartridge, may be of any kind or size. Any kind of film accommodated in any type of film cartridge can be automatically rewound into the second container, which is specially designed for the developing machine.

A magnetic read-out (or writing) device and/or a curl remover may be provided in the film feed path if such a path is of a sufficient length.

The automatic film rewinder of this invention makes it possible to automatically rewind films into the container specially designed for the developing machine without a conventional black box. Thus, it is possible to save labor and improve workability.

BRIEF DESCRIPTION OF THE DRAWINGS

Other features and objects of the present invention will become apparent from the following description made with reference to the accompanying drawings, in which.

DETAILED DESCRIPTION OF THE PREFERRED EMBODIMENT

Figure 1:
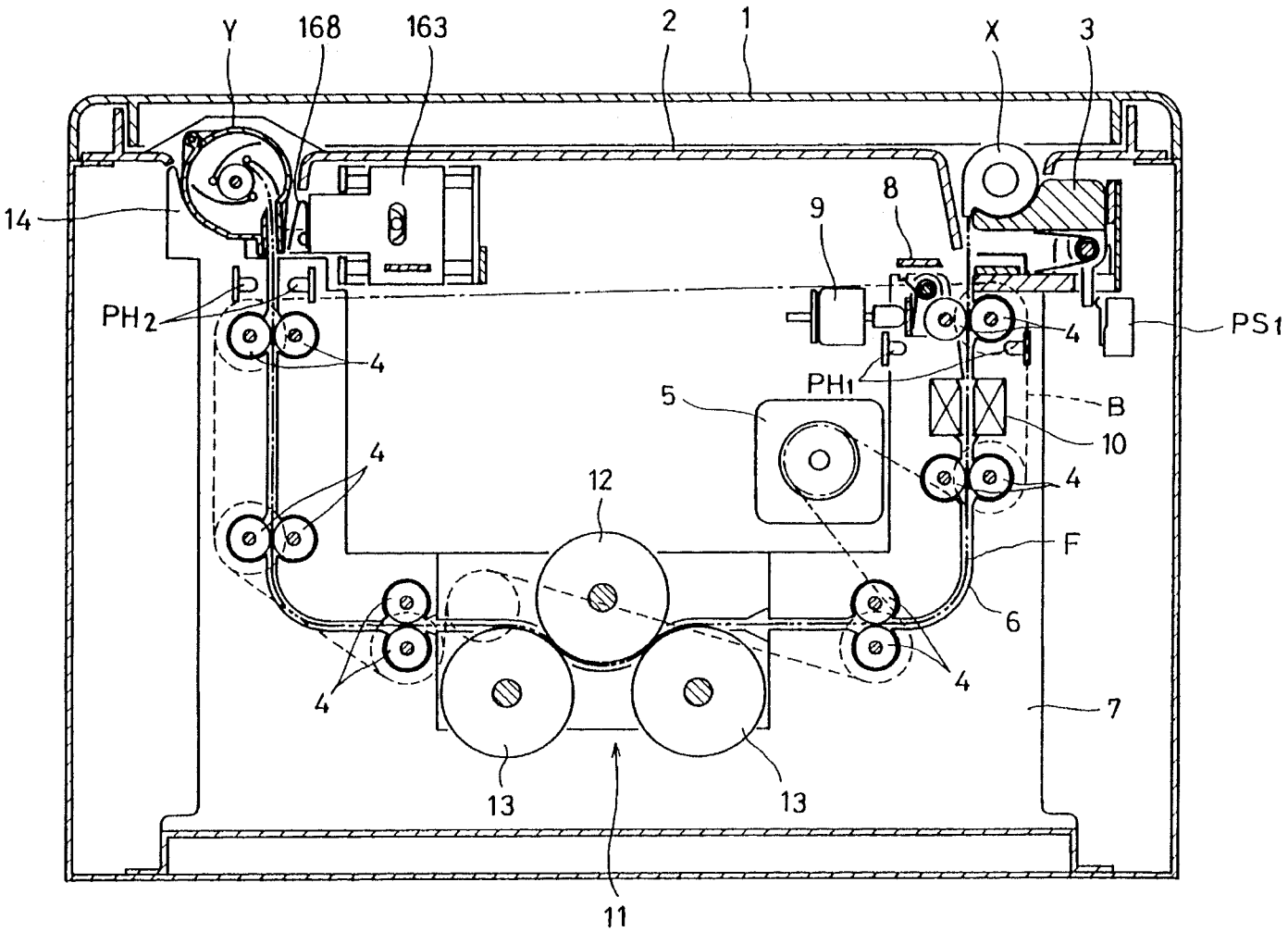
FIG. 1 is a sectional view of an automatic film rewinder of the present invention.

In FIG. 1, numeral 1 designates a case. At one end of a top plate 2, where it is recessed, is provided a support member 3 on which is set a film cartridge X accommodating a film F.

The film is pulled out of the film cartridge X and fed in a film guide 6 by a film feed device. The film feed device comprises a plurality of pairs of feed rollers 4 pulleys that are each coupled to one of each pair of rollers, a belt (or a chain) B in engagement with the pulleys, and a film feed motor 5 for driving the belt B. Basically, the component parts of the film feed device are mounted on a mounting plate 7.

Figure 2:
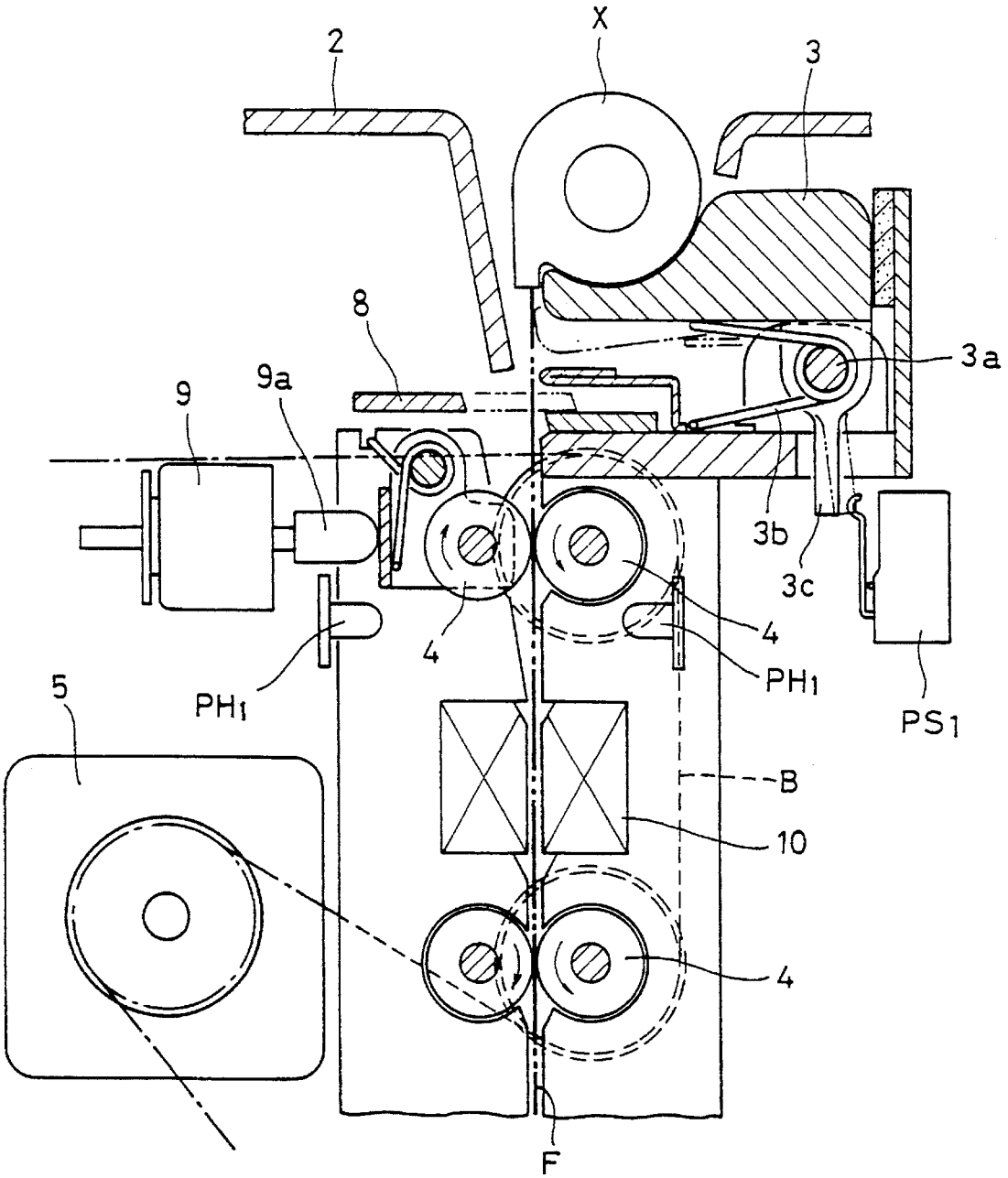
FIG. 2 is an enlarged view showing an inlet portion of the same.

A cutting unit 8 for cutting the rear end of the film F is provided in the film feed path immediately behind the film cartridge X. FIG. 2 illustrates the detailed structure of the inlet portion of the device. The cutting unit 8 has a cutter movable to a position shown by a two-dot chain line in FIG. 2 to cut the rear end of the film F after it has been completely pulled out of the film cartridge.

The support member 3 is pivotally mounted on a support shaft 3a and is normally kept horizontally biased by a spring 3*b*. When the film is completely fed out of the film cartridge X and further pulled, the support member 3 is pivoted down against the bias of the spring 3*b* until a protrusion 3*c* provided on the bottom of the spring 3*b* abuts a position detector PS1, which then produces a signal. The cutting unit 8 is activated by this signal.

When the front end of the film F accommodated in the film cartridge X is detected by a photo-detector PH1 (comprising a light source and a light receptor), it will produce a signal, which activates a solenoid 9. A head 9*a* of the solenoid 9 will then move toward the frontmost pair of feed rollers 4, i.e. the feed roller pair located nearest to the support member 3, to press one of the rollers against the other with the film sandwiched therebetween. The film is thus fed.

Only the frontmost pair of feed rollers 4 are adapted to be pressed against each other in response to the detection signal. While the film F is not being fed, the spring is in a position where it does not press the rollers against each other. The other pairs of feed rollers are pressed against each other at all times.

Numeral 10 designates a magnetic head unit for reading out the information written on the film F or writing in information onto the film while the film is being fed. Numeral 11 designates a curl remover for removing any curling tendency of the film. It comprises a heating drum 12 and two presser drums 13. Any curling tendency of the film is removed by being heated while passing between the drums.

Figure 5:
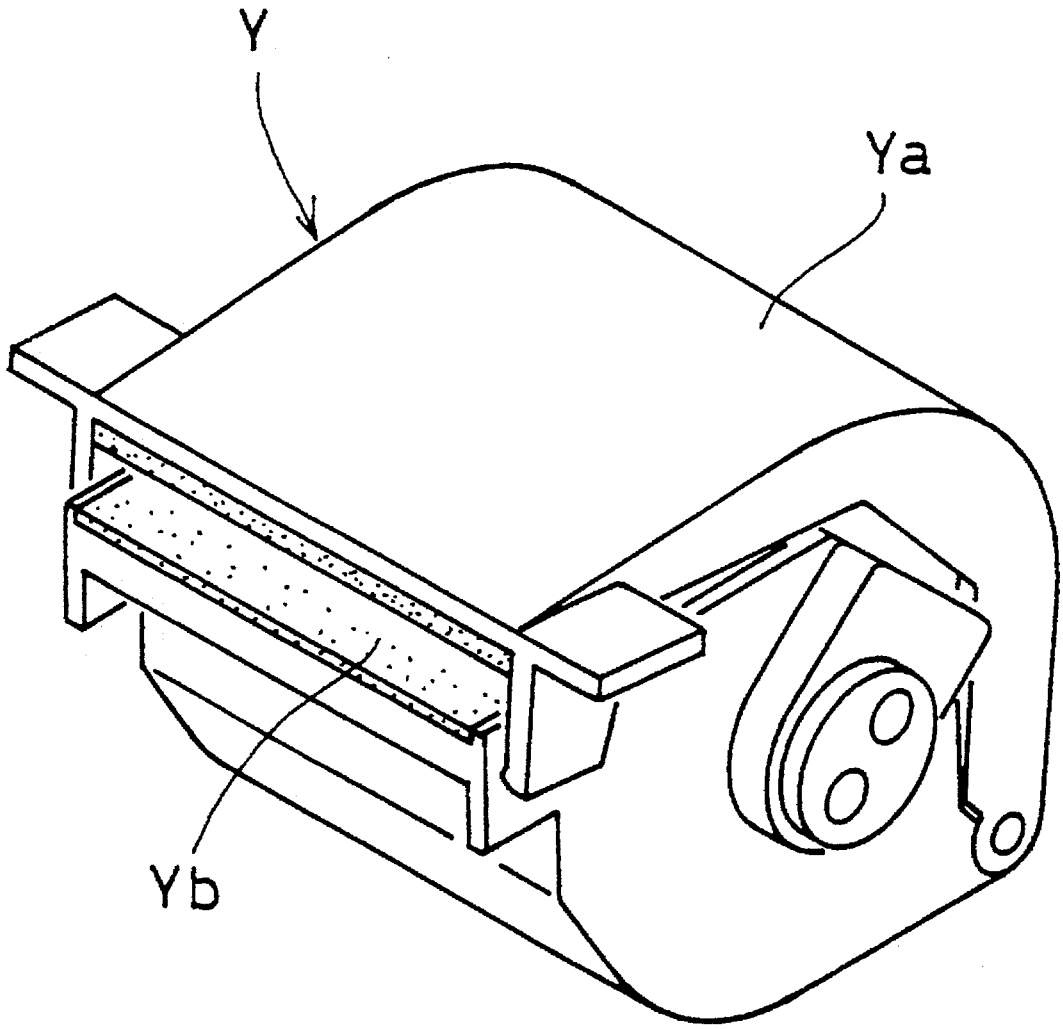
FIG. 5 is a perspective view of a take-up magazine.

At the terminal end of the film feed path is provided a support 14 on which is set a take-up magazine Y as another case for the film, which is exclusively used with a developing machine. FIG. 5 shows the outer configuration of the take-up magazine Y. Its case is divided into two halves. One of the halves rotatably carries a take-up shaft, while the other serves as an openable light-shielding cover Ya. A light-shield slit Yb through which the film F is inserted is provided at one end toward which the light-shielding cover Ya is closed.

Figure 3:
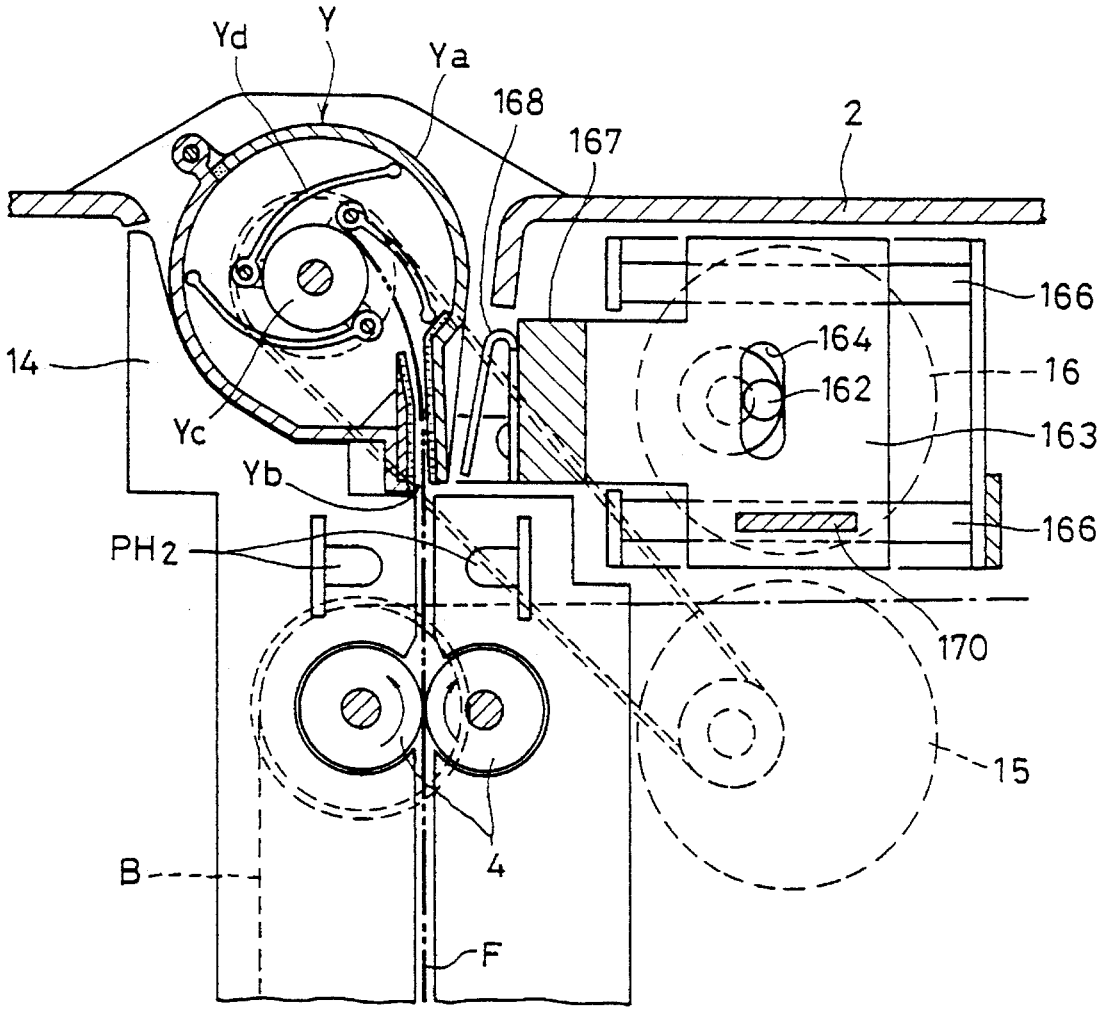
FIG. 3 is an enlarged view showing an outlet portion of the same.

As shown in FIG. 3, the take-up magazine Y is set so that the light-shield slit Yb is connected to the outlet of the film feed path. The film F is thus wound onto the take-up shaft Yc. Yd is a guide for guiding the film F when inserted into the light-shield slit Yb.

Figure 4:
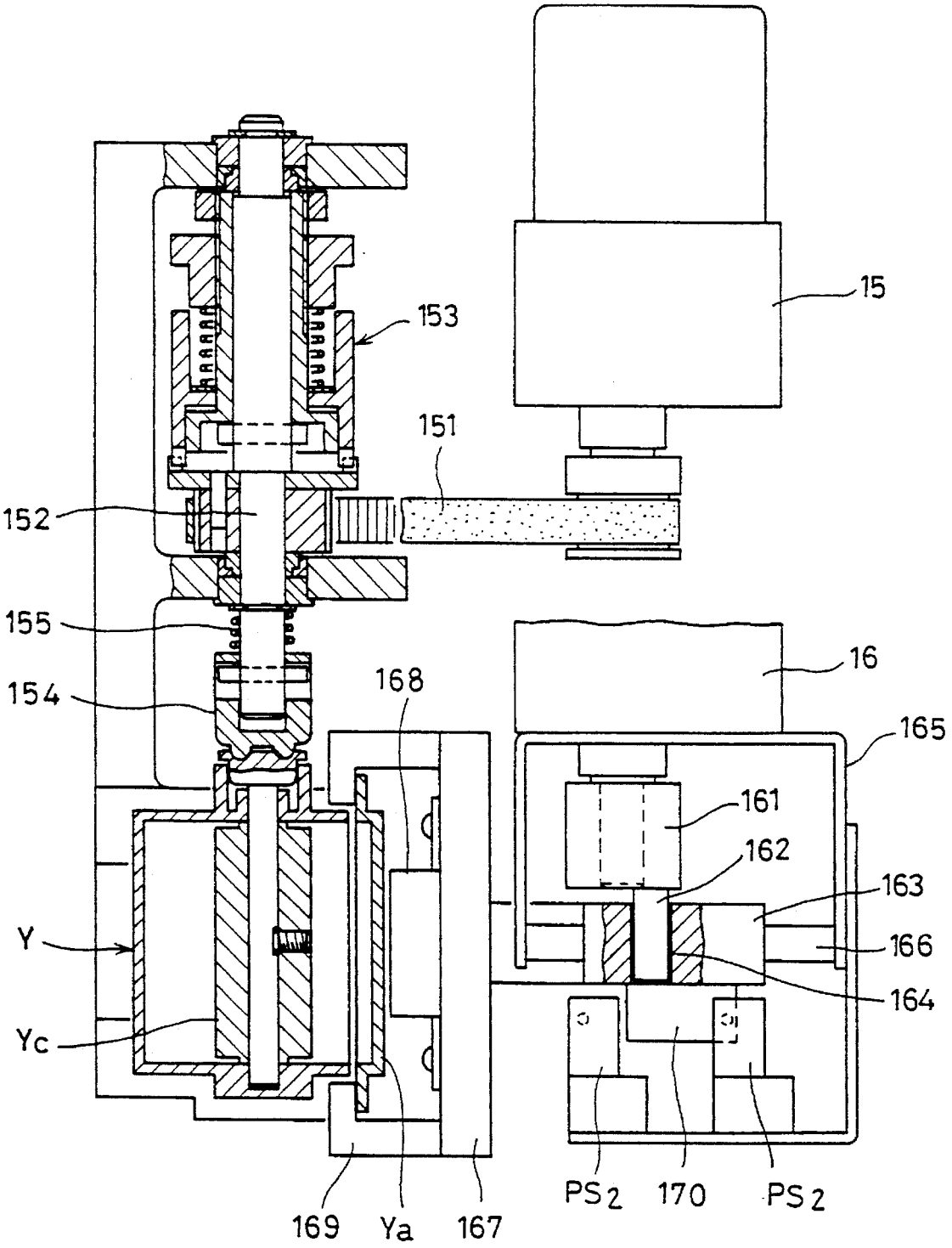
FIG. 4 is a plan view of a portion shown in FIG. 3.

The take-up unit for winding the film F into the take-up magazine Y further comprises a take-up shaft driving motor 15 for driving the take-up shaft Yc and a driving motor 16 for opening and closing the light-shielding cover Ya. FIG. 4 is a plan view showing the detailed structure of the take-up portion.

The output of the take-up shaft driving motor 15 is transmitted by way of a belt 151 to a rotary shaft 152 aligned with the take-up shaft Yc of the take-up magazine Y (FIG. 4). To one end of the rotary shaft 152 is connected a torque limiter 153. To its other end is mounted, through a spring 155, a coupling end 154 coupled to the take-up shaft Yc of the magazine so that its axial position is adjustable.

The cover driving motor 16 has an output shaft 161 carrying an eccentric pin 162 which is provided offset from the axis of the shaft 161 and engaged in an elongated hole 164 formed in a slide plate 163 of the mechanism for opening and closing the cover. The slide plate 163 is slidably supported by upper and lower guide rods 166 supported on a frame 165 fixed to the driving motor 16.

As shown in the plan view of FIG. 4, a ⊐-shaped arm 167 for opening and closing the cover Ya is mounted to one end of the slide plate 163. A spring plate 168 is secured to the center of the ⊐-shaped arm 167. To close the light-shielding cover Ya of the take-up magazine Y, the spring plate 168 is pressed against the cover. To open the cover, the ends of the light-shielding cover Ya are pulled by hooks 169 formed on the front end of the ⊐-shaped arm 167 (FIG. 4).

The slide plate 163 carries a position detector PS2 for detecting its own position by detecting the position of a light-shielding plate 170.

PH2 in FIG. 3 indicates a film detector. When a predetermined time has elapsed after the tail end of the film F had passed the detector PH2, it produces a detection signal to deactivate the take-up device, the film feed motor, etc.

The automatic film rewinder of this embodiment makes it possible to rewind films pulled out of various kinds of film cartridges onto the take-up magazine used exclusively for a developing machine. Its operation is described below.

Before starting rewinding, the take-up magazine Y is set on the support 14 and the light-shield slit Yb of the magazine is opened by the driving motor 16 for opening and closing the cover. In this state, the film feed motor 5 and the take-up shaft driving motor 15 are activated.

When the film accommodated in the film cartridge X set on the support member 3 is pulled out a little and its front end reaches the film detector PH1, it produces a detection signal, which activates the solenoid 9. The film feeding step thus begins. After setting a film cartridge X on the support member 3, a lid (not shown) on the top plate 2 is closed to shield the film from light.

While the film is being fed through the film guide 6, magnetic information is read out (or written in) by the magnetic head unit 10. Thereafter, any curling tendency of the film is removed by the curl remover 11.

When the front end of the film is fed into the take-up magazine Y, the film is taken up. The film take-up speed is set higher than the film feed speed. The synchronization of the speeds is effected by the slip of the torque limiter 153.

Once the film F is completely pulled out of the film cartridge X, the film cartridge X itself is pulled, so that the support member 3 pivots until the photo-detector PH1 is turned on and produces a detection signal. This activates the cutting unit 8 to cut the rear end of the film F. In this embodiment, the film F is cut off from the film cartridge by means of the cutting unit 8. But the means for separating the film F from the film cartridge is not limited thereto.

When the film is further fed and its rear end is detected by the film detector PH2, the film feed motor 5 and the film take-up shaft driving motor 15 are stopped and the light-shield slit Yb of the magazine is closed by the driving motor 16.

In the embodiment, the light-shielding cover of the take-up magazine is opened and closed by the light-shielding cover driving unit. But it is possible to dispense with the light-shielding cover driving unit if the take-up magazine is provided with an elastic means for urging its cover in the closing direction at all times and a protrusion for opening the cover when setting the magazine on the take-up device.

What is claimed is:

1. An automatic film rewinder, comprising:

a first support means for supporting a first container accommodating a film;

a cutter means for cutting a rear end of the film accommodated in the first container;

a second support means for supporting a second container;

a film feed device for feeding the film in the first container to the second container, said film feed device having a magnetic means for reading magnetic information recorded on the film and writing magnetic information onto the film while the film is being fed through said film feed device and a curl removing means for removing any curling tendency of the film while the film is being fed through the film feed device by heating the film with a heating drum having two presser drums pressing the film into contact with said heating drum; and a take-up means for taking up the film into the second container, said take-up means comprising a means for opening and closing a film inlet and outlet of the second container.

2. An automatic film rewinder, comprising:

a case;

a first support mounted in said case for supporting a first container accommodating a film;

a second support mounted in said case for supporting a second container;

a film feed device defining a film feed path in said case between said first support and said second support and comprising a plurality of rollers for feeding film in the first container to the second container, said film feed device including a magnetic head located along said film feed path for reading magnetic information recorded on the film and writing magnetic information onto the film while the film is being fed through said film feed device and a curl remover located along said film feed path for removing any curling tendency of the film while the film is being fed through the film feed device, said curl remover comprising a heating drum and two presser drums in contact with said heating drum;

a cutter located along said film feed path adjacent to said first support; and a take-up motor located at said second support for rotating a take-up shaft of the second container and a cover driving motor located at said second support for opening and closing a cover of the second container.

3. The automatic film rewinder of claim 1, wherein said first support comprises a pivotally mounted support member having a spring biasing said support member to a first position and a position detector for detecting movement of said support member to a second position and producing a cutting signal in response thereto.

4. The automatic film rewinder of claim 1, wherein said film feed device comprises a plurality of pairs of rollers located along said film feed path.

5. The automatic film rewinder of claim 1, wherein said film feed device comprises a pair of rollers located along said film feed path adjacent to said first support member, one of said rollers being movably mounted and spring biased to a position spaced apart from the other said roller, said film feed device further comprising a photo-detector for producing a signal when film is in said film feed path and a solenoid activatable by said signal, the one of said rollers being movable by said solenoid toward the other of said rollers to engage and advance the film.

6. The automatic film rewinder of claim 1, wherein said cover driving motor has a shaft connected with an eccentric member, which is in turn connected with a slide engageable with the cover.

7. The automatic film rewinder of claim 6, wherein said slide has a spring thereon for engagement with the cover to bias the cover toward a closed position.

* * * * *